US007325311B2

(12) United States Patent
Shimizu

(10) Patent No.: US 7,325,311 B2
(45) Date of Patent: Feb. 5, 2008

(54) RECIPROCATING-TYPE ELECTRIC SHAVER

(75) Inventor: Tetsuhiko Shimizu, Matsumoto (JP)

(73) Assignee: Izumi Products Company, Nagano (JP)

( * ) Notice: Subject to any disclaimer, the term of this patent is extended or adjusted under 35 U.S.C. 154(b) by 83 days.

(21) Appl. No.: 11/286,615

(22) Filed: Nov. 23, 2005

(65) Prior Publication Data

US 2006/0107530 A1 May 25, 2006

(30) Foreign Application Priority Data

Nov. 25, 2004 (JP) ..... 2004-340838

(51) Int. Cl.
*B26B 19/02* (2006.01)

(52) U.S. Cl. ..... 30/43.92; 30/346.51

(58) Field of Classification Search ..... 30/43.91, 30/43.92, 43.7, 43.8, 43.9, 346.51
See application file for complete search history.

(56) References Cited

U.S. PATENT DOCUMENTS 3,973,323 A * 8/1976 Trees ..... 30/43.92
4,993,152 A * 2/1991 Deubler ..... 30/43.92
5,414,930 A * 5/1995 Muller et al. ..... 30/43.3
5,704,126 A * 1/1998 Franke et al. ..... 30/34.1
6,226,871 B1 * 5/2001 Eichhorn et al. ..... 30/43.92
2002/0157257 A1 * 10/2002 Oswald ..... 30/43.92
2004/0231160 A1 * 11/2004 Shiba et al. ..... 30/43.92
2005/0028371 A1 * 2/2005 Kakimoto ..... 30/43.92

FOREIGN PATENT DOCUMENTS

| | | |
|---|---|---|
| EP | 0 678 362 | 10/1995 |
| EP | 1 398 122 | 3/2004 |
| JP | 2002-011265 | 1/2002 |
| JP | 2004-049864 | 2/2004 |

* cited by examiner

*Primary Examiner*—Hwei-Siu C. Payer
(74) *Attorney, Agent, or Firm*—William L. Androlia; H. Henry Koda

(57) ABSTRACT

A reciprocating-type electric shaver including an outer cutter having an inverted U shape as seen from a side thereof and an inner cutter making a reciprocating motion while making sliding contact with an inside surface of outer cutter, and further including: an oscillator making a reciprocating motion by a motor installed inside the main body of the shaver; a central shaft provided in an upright position on the oscillator and rises toward the inside of the outer cutter; an inner cutter holder disposed in a slidable manner on the central shaft so that the inner cutter holder holds the inner cutter thereon and the inner cutter swings about a straight line that is perpendicular to the reciprocating direction of the inner cutter; and a spring compressedly installed between the oscillator and the inner cutter holder.

3 Claims, 3 Drawing Sheets

RECIPROCATING-TYPE ELECTRIC SHAVER

BACKGROUND OF THE INVENTION

1. Field of the Invention

The present invention relates to a reciprocating-type electric shaver in which an inner cutter reciprocates inside an outer cutter, thus shaving hair and the like.

2. Description of the Related Art

In reciprocating-type electric shavers, an inner cutter, as well known, reciprocates while making sliding contact with the inside surface of an outer cutter which has substantially an inverted U shape when seen from the side, thus cutting hair entered in the slits formed in the outer cutter. In such electric shavers, the outer cutter inclines and sinks inward (on sinks into the shaver head) when it is moved during the shaving along the curved surfaces of the skin, so that the cutter surface of the outer cutter makes tight contact with the skin, thus increasing the hair cutting capability. In this structure, the inner cutter also inclines and sinks inward together with the outer cutter.

Japanese Patent Application Laid-Open (Kokai) Nos. 2004-49864 and 2002-11265 disclose shavers in which the inner cutter is formed in substantially an inverted U shape (as seen from the side) by bending a thin plate into an arch form, bifurcated claws are respectively protrude downward from the two facing lower edges of this inner cutter, an inner cutter the float-fitting member is fastened to a total of four claws, and this inner cutter the float-fitting member is held by oscillator so that an inner cutter the float-fitting member is capable of making a float movement. More specifically, the side surfaces of the float-fitting member is set to face in the reciprocating direction of the inner cutter, and it is brought into an engage in the reciprocating direction of the inner cutter with a pair of guides that protrude from the upper surface of the oscillator, and a coil spring is compressedly installed between the float-fitting member and the oscillator so that the float-fitting member is urged upward.

In this structure, in order to allow free upward and downward movement (free inward sinking) and free swing motion in the lateral (or left-right) direction of the float-fitting member, the engaged portions of the float-fitting member and guides of the oscillator are provided with sufficient play in between. Furthermore, while protruding portions that protrude in the reciprocating direction of the inner cutter are formed on the lower portion of the float-fitting member, claws that engage with the protruding portions of this the float-fitting member and thus prevent the float-fitting member from falling of the guides of the oscillator are disposed on the upper ends of the guides.

As seen from the above, in the conventional electric shavers, in order to hold the float-fitting member that is integrally fastened to the inner cutter so that the float-fitting member is swingable and sinkable inward with respect to the pair of guides protruding from the oscillator, it is necessary to provide sufficient play between the float-fitting member and the guides. When a large amount of play is provided, problems would occur. Namely, the noise, which is generated when the inner cutter reciprocate by the oscillator, increases. The reason for this is that the oscillator idles by an amount equal to the amount of play when the direction of movement of the oscillator varies, and the guides subsequently comes into contact with the float-fitting member, thus causing the float-fitting member to move in the opposite direction.

SUMMARY OF THE INVENTION

Therefore, it is an object of the present invention to provide a reciprocating-type electric shaver in which the noise caused by the reciprocating motion of the inner cutter is suppressed, assuring a smooth operation and improving the feeling of use of a reciprocating-type electric shaver.

The above object is accomplished by a unique structure of the present invention for a reciprocating-type electric shaver that includes an outer cutter having an inverted U shape as seen from a side thereof and an inner cutter making a reciprocating motion while making sliding contact with an inside surface of outer cutter; and in the present invention, the shaver further includes:

- an oscillator which is driven in a reciprocating motion by a motor installed inside the main body of the shaver;
- a central shaft which is provided in an upright position on the oscillator and rises toward the inside of the outer cutter;
- an inner cutter holder which is disposed on the central shaft so that the inner cutter holder is slidable on the central shaft, the inner cutter holder holding the inner cutter thereon so that the inner cutter swings about a straight line that is perpendicular to the reciprocating direction of the inner cutter; and
- a spring which is compressedly provided between the oscillator and the inner cutter holder.

In the above structure of the present invention, the inner cutter is provided so that it swings to the left and right with respect to the inner cutter holder (that corresponds to the float-fitting member), and the inner cutter holder is disposed so that it is movable upward and downward (i.e., free to sink inward) on the central shaft that is installed on the oscillator in an upright position. Accordingly, a minimal amount of play between the inner cutter base and oscillator in the reciprocating direction of the inner cutter is sufficient. Furthermore, there is no need for providing play in the reciprocating direction of the inner cutter in the engaging parts between the inner cutter and inner cutter holder. Consequently, the noise that is generated with the inner cutter holder when the oscillator makes its reciprocating motion is extremely small; and the noise that is generated during the use of the shaver is small, so that smooth and quiet operation is assured, and the shaver has an improved feeling of use.

In the present invention, a straight line, which passes through the supporting point (i.e., the swing center point) where the inner cutter is provided so as to be free to swing on the inner cutter holding body, and which is perpendicular to the reciprocating direction of the inner cutter, is positioned in the vicinity of the upper edge of the part of the inner cutter holder that slides with respect to the central shaft, or a straight line is positioned above this upper edge (on the inner cutter side). Thus, the height of the position of the swing center point of the inner cutter is set to be high. A sliding resistance oriented in the opposite direction from the direction of movement of the inner cutter acts on the sliding surfaces of the inner cutter, and thus a moment centered on this swing center point acts on the inner cutter. Accordingly, with the position of the swing center point set to be high as described above and being closer to the sliding surfaces of the inner cutter, such moment decreases, and the moment applied to the inner cutter holder also decreases. Consequently, the inner cutter holder can move or slide smoothly upward and downward on the central shaft, and the inner cutter makes reciprocating movement much smoothly.

Furthermore, in the present invention, the inner cutter holder that slides on the central shaft has sliding contact portions in which a sliding contact portion associated with the reciprocating direction of the inner cutter is set to be longer than a sliding contact portion associated with a direction which is perpendicular to the reciprocating direction, so that the inner cutter holder is prevented from titling in the reciprocating direction of the inner cutter. Accordingly, the inner cutter holder shows a much smaller tendency to tilt in the reciprocating direction of the inner cutter in response to the above-described moment that acts on the inner cutter.

Meanwhile, the sliding contact length of the inner cutter holder in the direction which is perpendicular to the reciprocating direction of the inner cutter is set to be short, the inner cutter tends to tilt in this direction, and a tight contact of the inner cutter with the outer cutter is assured. More specifically, since the outer cutter is ordinarily made of an extremely thin metal plate, when an external force is applied to the outer cutter in the direction which is perpendicular to the reciprocating direction of the inner cutter, the outer cutter undergoes a slight deformation and moves. In this case, since the inner cutter tilts easily in this direction, it can therefore maintain a tight contact with the outer cutter.

In the present invention, the oscillator is provided with a pair of guides, and these guides have engagement claws which restrict the rotation of the inner cutter holder about the central shaft while permitting the movement of the inner cutter holder in a direction of the central shaft or in a vertical direction, and the engagement claws further prevent the inner cutter holder from coming off of the upper end of the central shaft. With this structure, the inner cutter holder makes its upward-downward movement much smoothly. Furthermore, with this structure, the inner cutter and the inner cutter holder are maintained in an assembled state on the oscillator when the outer cutter is removed. Accordingly, the assembly and disassembly of the shaver head is easily done, and thus the structure is convenient for cleaning away the shaving debris.

DETAILED DESCRIPTION OF THE INVENTION

Figure 1:
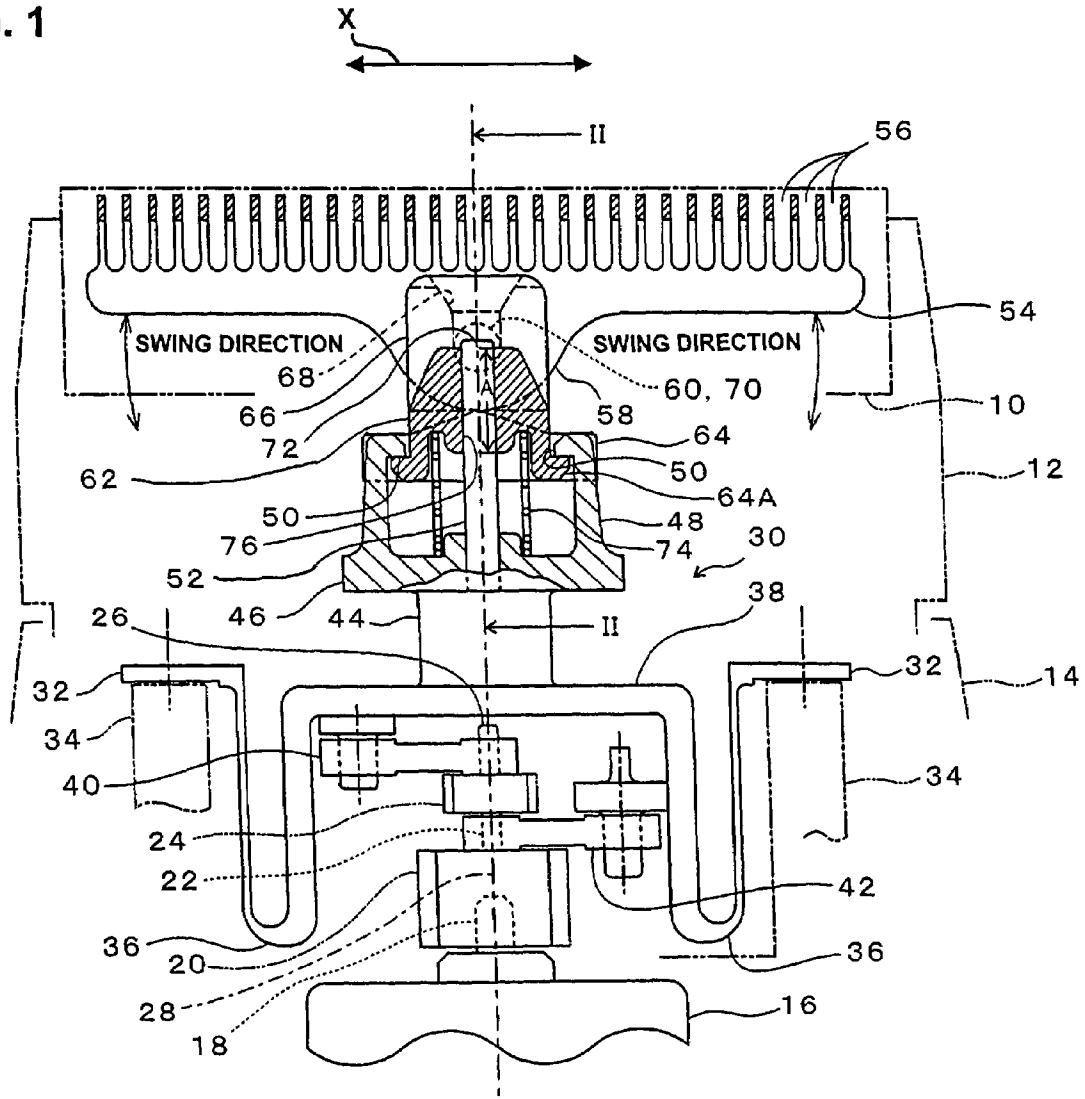
FIG. 1 is a partially sectional front view of the shaver head of the reciprocating-type electric shaver according to one embodiment of the present invention.

In FIG. 1, the reference numeral 10 is an outer cutter which is formed substantially in an inverted U shape (when viewed from the side (FIG. 2)) by bending into an arch shape a thin metal plate in which numerous small holes are formed. The outer cutter 10 is accommodated in a shaver head cover 12, and a part of this outer cutter 10 including its upper edge protrudes upward from the shaver head cover 12. The outer cutter 10 is installed in the shaver head cover 12 from below. While the outer cutter 10 is prevented from coming out of the shaver head cover 12 in the upward direction, the outer cutter 10 is allowed to make a specified amount of movement in downward direction.

The shaver head that includes the shaver head cover 12 is detachably mounted on the shaver main body 14, or it is provided so that it is opened and closed with respect to the shaver main body 14.

An electric motor 16, battery, switch, control circuit and the like are provided inside the shaver main body 14.

The rotary shaft 18 of the motor 16 rises perpendicularly upward from the center of the upper part of the shaver main body 14. A first joint 20 is fastened to the rotary shaft 18, and a second joint 24 is fastened to this first joint 20 via a first eccentric pin 22. A second eccentric pin 26 is installed in an upright position on the second joint 24. The first and second eccentric pins 22 and 26 are positioned on a shaver center line 28 that is parallel to and along the rotary shaft 18 and passes through the rotary shaft 18, and they are in symmetrical positions on either side of the second joint 24.

The reference numeral 30 is an oscillator. The oscillator 30 has attachment portions 32 on both (the left and right) ends. These attachment portions 32 are fastened to the upper surfaces of a pair of upright columns 34 (left and right upright columns) that are formed in the shaver main body 14. The left and right attachment portions 32 of the oscillator 30 are suspended from the upright columns 34, so that the central (horizontal) portion 38 between these attachment portions 32 via U-shaped bent portions 36 can oscillate laterally or in the left-right direction in FIG. 1. The central portion 38 is connected to the second eccentric pin 26 by a link 40; so that when the rotary shaft 18 of the motor 16 rotates, the central portion 38 of the oscillator 30 is caused to oscillate laterally or in the left-right direction by the link 40.

Another (or second) oscillator (not shown in the drawings) of the same shape and structure as the shown oscillator 30 is provided on the upright columns 34 and near the oscillator 30, and the central portion of this second oscillator is connected to the first eccentric pin 22 by a link 42. The other (second) oscillator drives another inner cutter that is disposed parallel to the outer cutter 10 but not shown in FIGS. 1 and 2.

A supporting column 44 is uprightly disposed on the upper surface of the central portion 38 of the oscillator 30, and a guide holding plate 46 is integrally provided on the upper end of the supporting column 44.

A pair of guides 48 (left and right guides 48) are formed uprightly on the guide holding plate 46. Engagement claws 50 that protrude inside or toward the center of the guide holding plate 46 are formed on the upper ends of the guides 48. The engagement claws 50 are for preventing the inner cutter holder 62 (described later) from falling out.

A central shaft 52 which rises perpendicularly upward is installed in the center of the guide holding plate 46.

Figure 2:
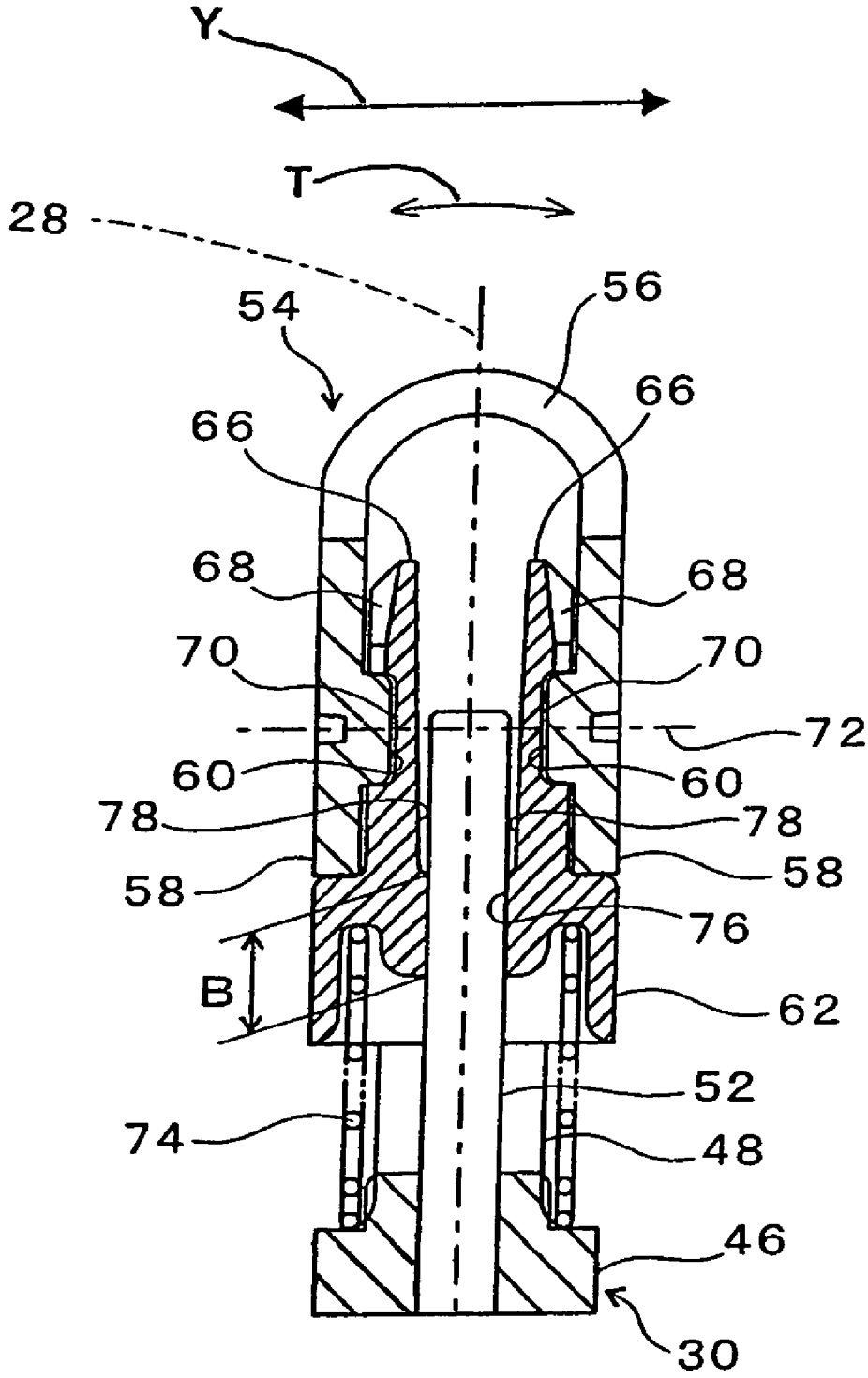
FIG. 2 is a sectional view taken along the line II-II in FIG. 1.
Figure 3:
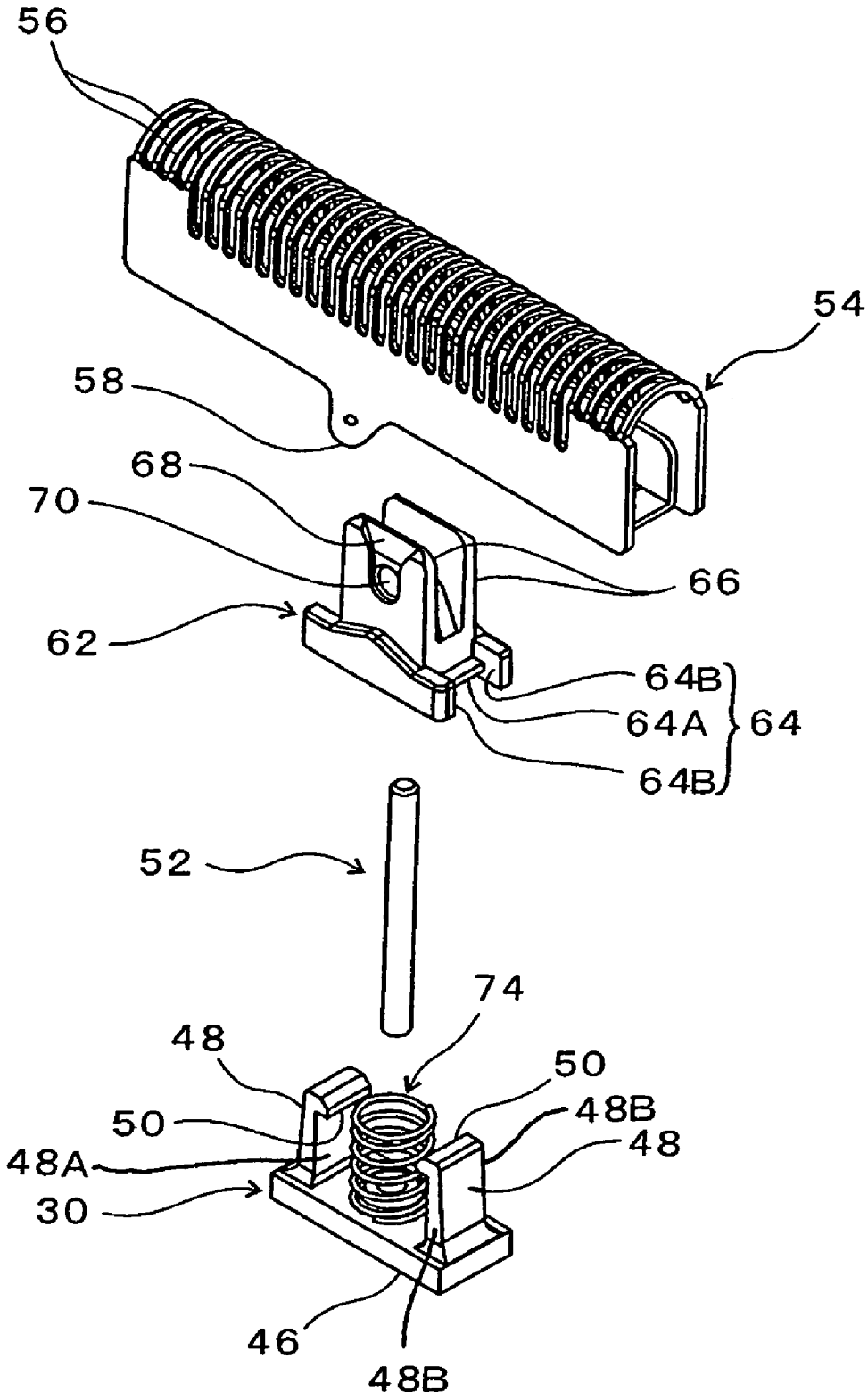
FIG. 3 is a perspective view of the essential portion of the reciprocating-type electric shaver of the present invention.

An inner cutter 54 is, as seen from FIG. 3, in substantially an inverted U shape (when viewed from the side as shown in FIG. 2) which is obtained by bending a metal plate into an arch shape, and it is formed with numerous slits 56 that are worked or opened so that the slits cross the ridge of the arch shaped metal plate. The inner cutter 54 has semicircular protrusions 58 that protrude downwardly from the two opposite lower edges. As seen from FIG. 2, projections 60 are formed on the facing inner surfaces of these semicircular protrusions 58.

The reference numeral 62 is an inner cutter holder. The above-described central shaft 52 passes through the center of the inner cutter holder 62, and the inner cutter holder 62 is slidably provided on this central shaft 52 so that it can move upward and downward on the central shaft 52.

Two sets of three guide claws 64 (comprising one central claw 64A and two side claws 64B) are respectively formed at both (right and left) side ends of the inner cutter holder 62, so that each claw set 64 is at each one (right and left) of the edges of the lower portions of the inner cutter holder 62. The guide claws 64 engage with the two guides 48 of the oscillator 30. By the engagement of the guide claws 64 with the guides 48 of the oscillator 30, the inner cutter holder 62 is prohibited from rotating about the central shaft 52; however, the inner cutter holder 62 is movable up and down on the central shaft 52 and not restricted for this up and down movement by the guide claws 64 and guides 48.

A pair of upright walls 66 that enter the insides of the pair of semicircular protrusions 58 of the inner cutter 54 from below are formed on the upper part of the inner cutter holder 62. Guide grooves 68 that widen in the upward direction are formed in the outside surfaces of the upright walls 66, and the lower portions of the guide grooves 68 constitute recessed portions 70 (see FIG. 2) that are recessed in the direction of thickness of the upright walls 66. Accordingly, as seen from FIG. 2, the projections 60 of the inner cutter 54 are engaged with the recessed portions 70 of the inner cutter holder 62 when, while positioning the projections 60 of the inner cutter 54 in the guide grooves 68 of the inner cutter holder 62 from above, the upright walls 66 of the inner cutter holder 62 is pushed into from below between the semicircular protrusions 58 of the inner cutter 54. As a result, the inner cuter 54 is held on the inner cutter holder 62 by the elastic force of the upright walls 66 that acts in the opposite directions thereof.

As seen from FIG. 1, the projections 60 and recessed portions 70 have a circular shape with the diameter of the recessed portions 70 being slightly larger than the diameter of the projections 60 so that a little play in the diametrical direction exists between the projections 60 and the recessed portions 70, and the inner cutter 54 makes its swing motion about the recessed portions 70. More specifically, the straight line 72 passing through the centers of the projections 60 and recessed portions 70 (FIG. 2) is a straight line that is perpendicular to the reciprocating direction X of the inner cutter 54, and the swing center point of the inner cutter 54 is set on this straight line 72. Accordingly, the inner cutter 54, which is depressible along the central shaft 52, makes its swing motion about the straight line (or the swing center point) 72.

A coil spring 74, as seen from FIG. 1, is compressedly installed between the inner cutter holder 62 and the guide holding base 46 so as to surround the center shaft 52. The central claw 64A of each one of the three claws 64 of the inner cutter holder 62 that surround each guide 48 on three sides (three sides comprising one inner surface 48A and two side surfaces 48B) engages from below with the engagement claw 50 formed on the upper end of the corresponding guide 48. As a result, the inner cutter holder 62 is urged upward by the coil spring 74 and is prevented from slipping out of (the guide 48 of) the oscillator 30 in the upward direction by the two central claws 64A engaging with the engagement claws 50.

FIG. 1 shows a state that the central claws 64A at both ends of the inner cutter holder 62 and engagement claws 50 of the oscillator 30 are in contact or engaged, or a state in which the outer cutter 10 is removed. When, however, the outer cutter 10 is mounted, the inner cutter 54 is pressed by the outer cutter 10 inward or downward by the outer cutter 10 (and thus is depressed); as a result, the coil spring 74 is compressed, and the central claws 64A are separated from the engagement claws 50.

Next, the sliding portions of the inner cutter holder 62 and central shaft 52 will be described.

As seen from the front (FIG. 1), the upper edge of the through-hole 76 formed in the inner cutter holder 62 through which the central shaft 52 is passed is positioned at substantially the same height as the swing center point 72 of the inner cutter 54. More specifically, the sliding contact length A (FIG. 1), for which the inner cutter holder 62 slides on the central shaft 52 while contacting with the central shaft 52, in the reciprocating direction X of the inner cutter 54 is set to be sufficiently long in the downward direction, with the upper edge of the through-hole 76 being located at substantially the same height as the swing center point 72 (thus being in the vicinity of the swing center point 72). Accordingly, the inner cutter holder 62 is prevented from tilting in the reciprocating direction X of the inner cutter.

On the other hand, as seen from FIG. 2, the inner cutter holder 62 is structured so that deep grooves 78 that open in the upward direction are provided between its upright walls 66 and the central shaft 52. As a result, only the lower portion of inner cutter holder 62 is in contact with and makes sliding contact with the central shaft 52, so that the sliding contact length B (for which the inner cutter holder 62 slides on the central shaft 52 while contacting with the central shaft 52) in the direction Y which is perpendicular to the reciprocating direction X of the inner cutter when viewed from the side is set to be short (or shorter than the sliding contact length A). Consequently, the inner cutter holder 62 readily tilts in the direction Y which is perpendicular to the reciprocating direction X of the inner cutter or tilt in the direction shown by the curved arrow T in FIG. 2, so that the inner cutter 54 well conforms to the outer cutter 10, and the tight surface contact between the inner and outer cutters 54 and 10 is assured, thus providing high hair cutting capability.

As seen from the above, the inner cutter holder 62 has a sliding contact section which is inside the through-hole 76 and in which a first or upper sliding contact portion that has the sliding contact length A and contacts with the central shaft 52 in the reciprocating direction X of the inner cutter 54 and a second or lower sliding contact portion that has the sliding contact length B and contacts with the central shaft 52 in the direction Y which is perpendicular to the reciprocating direction X of the inner cutter 54*a*. In addition, the first or upper sliding contact section is set to be longer than the second or lower sliding contact section and sufficiently long or deep to hold the central shaft 53 securely so that the inner cutter holder 62 is prevented from tilting in the reciprocating direction X.

The shaver with the structure described above operates in the manner as described below.

When the rotary shaft 18 of the motor 16 rotates, the central portion 38 of the oscillator 30 makes a right and left reciprocating motion in FIG. 1, and thus the guide plate 46, guides 48, central shaft 52 on the central portion 38 of the oscillator 30 also make a reciprocating motion. The inner cutter holder 62 which is disposed on the central shaft 52 so that the inner cutter holder is slidable upward and downward is pressed downward together with the inner cutter 54 when the outer cutter 10 is pressed downward as it is pressed against the skin during the shaving, and the inner cutter holder 62 as a result slides downward on the central shaft 52.

When the outer cutter 10 tilts during the shaving, the inner cutter 54 also tilts (or swings) about the swing center point 72 together with this outer cutter 10. However, the swing center point 72 is located in a high position, i.e., at a position that is close to the sliding surface between the inner cutter 54 and outer cutter 10. Accordingly, the moment that acts on the swing center point 72 as a result of this sliding resistance is small, and this moment is released when the inner cutter 54 makes swing motion about the swing center point 72. Consequently, the moment that acts on the inner cutter holder 62 is an extremely small or zero, so that the inner cutter holder 62 makes its smooth vertical movement on the central shaft 52. Furthermore, since the amount of play between the inner cutter 54 and central shaft 52 with respect to the reciprocating direction X of the inner cutter is extremely small, noise is conspicuously reduced, and the shaver operates quietly.

Furthermore, in the sliding portions between the inner cutter holder 62 and the central shaft 52, since the sliding contact length A associated with the reciprocating direction X of the inner cutter is sufficiently long, the tilting of the inner cutter holder 62 is prevented sufficiently. Furthermore, since the sliding contact length B associated with the direction Y which is perpendicular to the reciprocating direction X of the inner cutter is sufficiently short, the inner cutter holder 62 readily tilts in the direction Y which is perpendicular to the reciprocating direction X, so that the inner cutter makes good contact with the outer cutter, improving the cutting capability.

The invention claimed is:

1. A reciprocating type electric shaver comprising an outer cutter that has an inverted U shape as seen from a side thereof and an inner cutter that makes a reciprocating motion while making sliding contact with an inside surface of the outer cutter, the shaver further comprising:

an oscillator which is driven in a reciprocating motion by a motor installed inside a main body of said shaver;

a central shaft which is provided in an upright position on said oscillator and rises toward an inside of said outer cutter;

an inner cutter holder which is slidably disposed on said central shaft so that said inner cutter holder holds said inner cutter thereon and said inner cutter swings about a straight line that is perpendicular to a reciprocating direction of said inner cutter; and a spring which is compressively provided between said oscillator and said inner cutter holder; and wherein a swing center point at which said inner cutter is held swingable on said inner cutter holder is positioned on or higher than an upper edge of a sliding contact section of said inner cutter holder that makes sliding contact with said central shaft in a reciprocating direction of said inner cutter.

2. The reciprocating type electric shaver according to claim 1, wherein said oscillator is provided with a pair of guides, said guides having engagement claws which restrict rotation of said inner cuter holder about said central shaft while permitting a movement of said inner cutter holder in a direction of said central shaft and which prevent said inner cutter holder from coming off of the central shaft.

3. A reciprocating-type electric shaver comprising an outer cutter that has an inverted U shape as seen from a side thereof and an inner cutter that makes a reciprocating motion while making sliding contact with an inside surface of said outer cutter, the shaver further comprising;

an oscillator which is driven in a reciprocating motion by a motor installed inside a main body of such shaver;

a central shaft which is provided in an upright position on said oscillator and rises toward an inside of said inner cutter;

an inner cutter bolder which is slidably disposed on said central shaft so that said inner cutter holder holds said inner cutter thereon and said inner cutter swings about a straight line that is perpendicular to a reciprocating direction of said inner cutter; and a spring which is compressibly provided between said oscillator and said inner cutter holder; and wherein said inner cutter holder that slides on said central shaft has sliding portions in which a sliding contact portion associated with said reciprocating direction of said inner cutter is set to be longer than a sliding contact portion associated with a direction which is perpendicular to said reciprocating direction, so that tilting of said inner cutter holder in said reciprocating direction of said inner cutter is restricted.

* * * * *